US009435333B2

(12) United States Patent
McCoy et al.

(10) Patent No.: US 9,435,333 B2
(45) Date of Patent: Sep. 6, 2016

(54) CORROSION RESISTANT FLUID END FOR WELL SERVICE PUMPS

(75) Inventors: Terry H. McCoy, Addison, TX (US); David M. Stribling, Duncan, OK (US); John Dexter Brunet, Duncan, OK (US); Stanley V. Stephenson, Duncan, OK (US); Timothy A. Freeney, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 349 days.

(21) Appl. No.: 13/332,452

(22) Filed: Dec. 21, 2011

(65) Prior Publication Data

US 2013/0161013 A1 Jun. 27, 2013

(51) Int. Cl.
*F04B 47/00* (2006.01)
*F04B 53/16* (2006.01)

(52) U.S. Cl.
CPC ..... *F04B 47/00* (2013.01); *F04B 53/16* (2013.01); *F05C 2201/021* (2013.01); *F05C 2201/0406* (2013.01); *F05C 2201/046* (2013.01); *F05C 2201/0412* (2013.01); *F05C 2201/0433* (2013.01); *F05C 2203/083* (2013.01); *F05C 2251/02* (2013.01); *Y10T 137/0402* (2015.04)

(58) Field of Classification Search
CPC ..... E21B 43/26; F15D 1/00; F04B 47/00; F04B 53/16; F05C 2201/021
USPC ..... 166/105, 250.3, 177.05, 90.1
See application file for complete search history.

(56) References Cited

U.S. PATENT DOCUMENTS

| | | | | |
|---|---|---|---|---|
| 5,102,312 | A | 4/1992 | Harvey | |
| 5,253,987 | A | 10/1993 | Harrison | |
| 5,366,643 | A | 11/1994 | Walker | |
| 5,441,929 | A * | 8/1995 | Walker | 507/260 |
| 7,906,462 | B2 * | 3/2011 | Mesher et al. | 507/203 |
| 2008/0000065 | A1 * | 1/2008 | Ganguly et al. | 29/421.1 |
| 2008/0078554 | A1 * | 4/2008 | Huff et al. | 166/363 |
| 2009/0081034 | A1 * | 3/2009 | Gambier et al. | 415/200 |
| 2010/0038070 | A1 * | 2/2010 | Blanco et al. | 166/105 |

* cited by examiner

*Primary Examiner* — Doug Hutton, Jr.
*Assistant Examiner* — Silvana Runyan
(74) *Attorney, Agent, or Firm* — McDermott Will & Emery LLP; John Wustenberg

(57) ABSTRACT

Corrosion resistant alloys in fluid ends to prolong the life of a well service pump. Methods of using such corrosion resistant alloys that provide a fluid end that has a corrosion resistant alloy having a fatigue limit greater than or equal to the tensile stress on the fluid end at maximum working pressure in the fluid end for an aqueous-based fluid; installing the fluid end in a well service pump; and pumping the aqueous-based fluid through the fluid end.

12 Claims, 1 Drawing Sheet

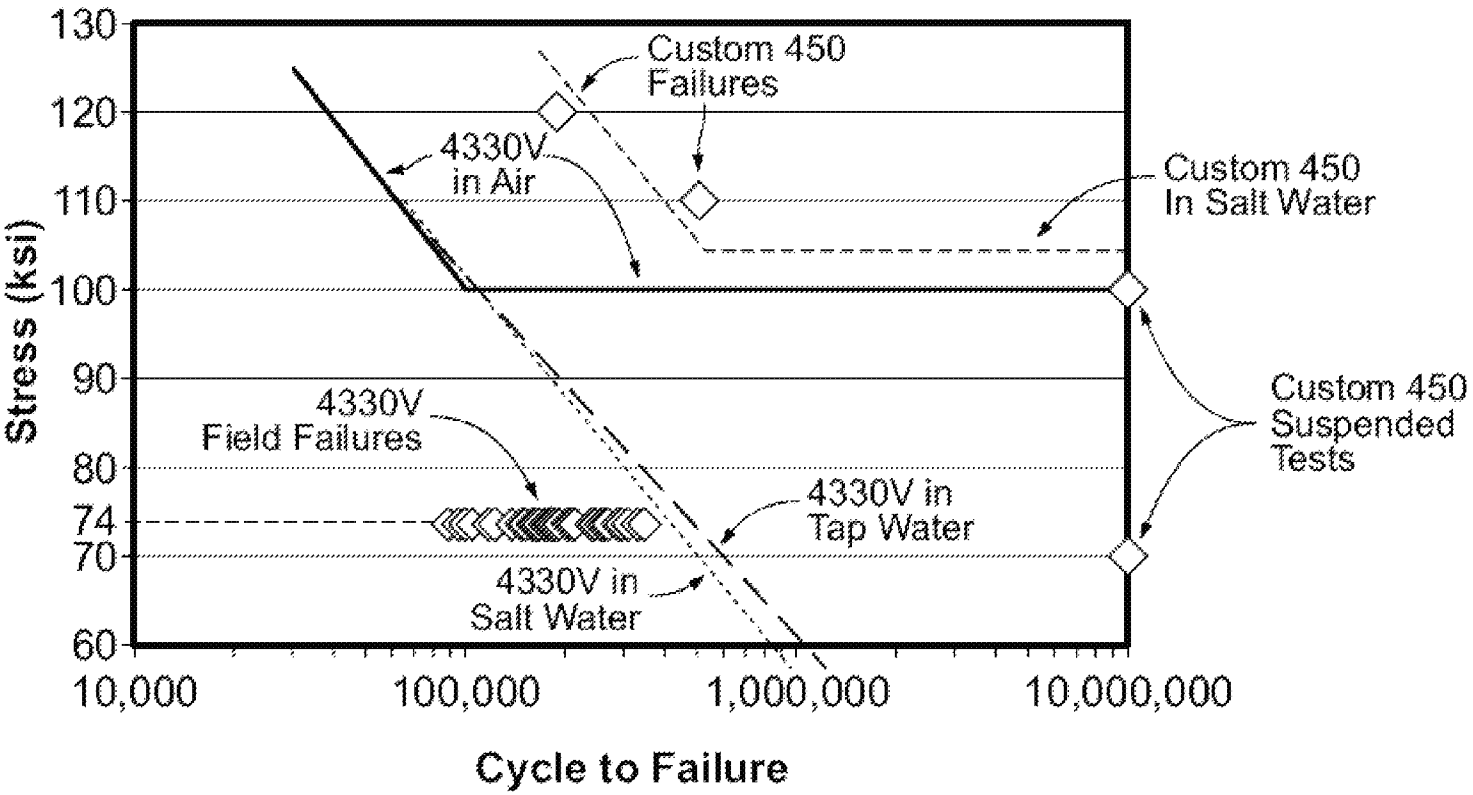
Custom 450
In Salt Water
Custom 450
Suspended
Tests
Custom 450
Failures
4330V
in Air
4330V in
Tap Water
4330V
Field Failures
4330V in
Salt Water
Stress (ksi)
130
120
110
100
90
80
74
70
60
10,000
100,000
1,000,000
10,000,000
Cycle to Failure

CORROSION RESISTANT FLUID END FOR WELL SERVICE PUMPS

BACKGROUND

The present invention relates to corrosion resistant alloys, and more particularly, to the use of corrosion resistant alloys as fluid ends to prolong the life of a well service pump.

Well service pumps are often used to introduce treatment fluids in a wellbore. For example, well service pumps are often used in hydraulic fracturing to increase or restore the rate at which fluids such as water, oil, and gas can be produced even from low permeability reservoir rocks. Well service pumps can be used to pump fluids that are used to create and/or extend existing fractures. These fractures allow oil or gas to travel more easily from the rock pores, where the oil or gas is trapped, to the production well. By pumping a fracturing fluid into a wellbore at a rate sufficient to increase the downhole pressure to a value in excess of the fracture gradient of the formation rock, a crack in the formation is created and allows the fracturing fluid to enter and extend the crack farther into the formation.

Well service pumps are usually provided with fluid ends within which reciprocating plungers place fluids under pressure. Typically, the body of a fluid end is an aggregate of metal blocks fastened to provide access to internal components for servicing. Suitable examples of fluid ends are disclosed in U.S. Pat. Nos. 5,102,312 and 5,253,987, which are hereby incorporated by reference. However, the joints between the blocks and the supporting features for the valves tend to weaken the body of a fluid end, limiting its pressure rating, and making it susceptible to corrosion, leaks and cracks. Moreover, fluid ends are often exposed to salt solutions under high pressures which can also lead to corrosion.

As used herein, "corrosion" refers to the disintegration of material into its constituent atoms due to chemical reactions with its surroundings. Corrosion can significantly reduce the fatigue life of a fluid end. As used herein, "fatigue" refers to the progressive and localized structural damage that occurs when a material is subjected to cyclic loading. Due to corrosion, it is not unusual for the bodies of fluid ends to fail under load, significantly cutting short their useful lives.

Fluid ends that break down can cause numerous and significant problems in the oilfield. For example, it is often very costly to replace a fluid end, which can cost tens of thousands of dollars if not more. Fluid ends often weigh hundred of pounds and a hoist is usually required to lift and position the various portions of a fluid end body. Consequently, treatment is often halted and delayed while waiting for replacement equipment which, in turn, can further compound the cost burden of replacing failed fluid ends.

SUMMARY OF THE INVENTION

The present invention relates to corrosion resistant alloys, and more particularly, to the use of corrosion resistant alloys as fluid ends to prolong the life of a well service pump.

In some embodiments, the present invention provides methods comprising: providing a fluid end that comprises a corrosion resistant alloy having a fatigue limit that is greater than or equal to the tensile stress experienced by the fluid end at maximum working pressure in the fluid end while processing an aqueous-based fluid; installing the fluid end in a well service pump; and pumping the aqueous-based fluid through the fluid end.

In some embodiments, the present invention provides methods comprising: providing a fluid end comprising: a corrosion resistant alloy having a fatigue limit greater than or equal to the tensile stress on the fluid end at maximum working pressure in the fluid end for an aqueous-based fluid including a corrosion inhibitor; installing the fluid end in a well service pump; and pumping the aqueous-based fluid through the fluid end.

In some embodiments, the present invention provides methods comprising: providing a well service pump that comprises a fluid end made from a corrosion resistant alloy, the corrosion resistant alloy comprising: iron; chromium; and an alloying element selected from the group consisting of: nickel, molybdenum, titanium, aluminum, copper, niobium, carbon, silicon, manganese, and any combination of these; and performing a fracturing treatment using the well service pump.

The features and advantages of the present invention will be readily apparent to those skilled in the art upon a reading of the description of the preferred embodiments that follows.

BRIEF DESCRIPTION OF THE DRAWINGS

The following FIGURE is included to illustrate certain aspects of the present invention, and should not be viewed as an exclusive embodiment. The subject matter disclosed is capable of considerable modification, alteration, and equivalents in form and function, as will occur to those skilled in the art and having the benefit of this disclosure.

FIG. 1 is a plot showing the result of fatigue tests as described in Example 1.

DETAILED DESCRIPTION

The present invention relates to corrosion resistant alloys, and more particularly, to the use of corrosion resistant alloys as fluid ends to prolong the life of a well service pump.

The present invention provides corrosion resistant alloys and methods of using the corrosion resistant alloys that provide superior resistance against corrosion. When used as a material for a fluid end of a well service pump, corrosion resistant alloys of the present invention can significantly prolong the usage life of the fluid end when compared to commonly used steel alloys.

A fluid end of a well service pump may come into contact with harsh chemicals such as salts and have extended exposures to fluids being pumped at high pressures. The fatigue life of commonly used steel alloys can be substantially reduced when cyclically stressed in this corrosive environment.

As used herein, "fatigue life" refers to the number of specified stress cycles that a material sustains before a specified failure occurs. As used herein, "stress cycle" refers to a period during which a load is applied to a component. This load may fluctuate in time. In a well service pump, a fluid end is typically exposed to about 70 ksi of cyclic stress.

Corrosion resistant alloys are intrinsically more resistant to corrosion due to the fundamental nature of the electrochemical processes involved and how the reaction products form. Without being limited by theory, it is believed that, for the corrosion resistant alloys of the present invention, corrosion is an unfavorable thermodynamic process. As a result, the corrosion resistant alloys may have a fatigue limit which will significantly increase their usage life. The corrosion resistant alloys may even have a fatigue limit even in the presence of relatively harsh fluids such as frac fluids, which often contain relatively high salt concentrations. As used herein, "fatigue limit" or "endurance limit" refers to the range of cyclic stress than can be applied to a material without causing fatigue failure. In other words, materials without a fatigue limit will eventually fail from even small stress amplitudes.

In some cases, it is also believed that the present invention will mitigate both corrosion pitting and surface distortion on fluid ends. Moreover, the use of corrosion inhibitors may offset the need to use expensive or not readily available corrosion resistant alloys.

The methods of the present invention generally comprise providing a fluid end comprising a corrosion resistant alloy having a fatigue limit that is greater than or equal to the tensile stress experienced by the fluid end at maximum working pressure while processing an aqueous-based fluid; installing the fluid end in a well service pump; and pumping the aqueous-based fluid through the fluid end. In some embodiments, the fatigue limit is at least about 75 ksi.

As used herein, "tensile stress" is the measure of internal forces acting within a deformable body. It may be considered as a measure of the average force per unit area of a surface within the body on which internal forces act.

The corrosion resistant alloys of the present invention may be steel alloys generally comprising steel alloying elements such as iron, but not limited to, chromium, nickel, molybdenum, titanium, aluminum, copper, niobium, carbon, silicon, manganese, and combinations thereof, or the like. In some embodiments, iron is the most abundant element by weight of the corrosion resistant alloy. In some embodiments, iron, nickel, and chromium are the three most abundant elements by weight of the corrosion resistant alloy. In some embodiments, chromium is present in an amount of about at least 5% by weight of the corrosion resistant alloy. Preferably, chromium is present in about 5% to about 20% by weight of the corrosion resistant alloy. An example of corrosion resistant alloy of the present invention is a stainless steel alloy commercially available as "CUSTOM 450®" from Carpenter Technology Corporation. CUSTOM 450® is a martensitic age-hardenable stainless steel that exhibits very good corrosion resistance with moderate strength. Without being limited by theory, it is believed that the specific combinations of steel alloying elements and their relative abundance imparts superior corrosion resistance to the corrosion resistance alloys.

The aqueous-based fluid may generally be a corrosive water-based fluid that may be pumped into a subterranean environment. Suitable examples of water-based fluids include, but are not limited to, brines, fracturing fluid, acids, combinations thereof, and the like. In some embodiments, the aqueous-based fluid may have a salt concentration of about 4% by weight or greater. In some embodiments, the aqueous-based fluid may further comprise a corrosion inhibitor. In some cases, the use of corrosion inhibitors may allow for the use of less effective corrosion resistant alloys.

Suitable examples of corrosion inhibitors include, but are not limited to, hexamines, benzotriazoles, phenylenediamines, dimethylethanolamines, polyanilines, nitrites, nitrates, aldehydes (e.g., cinnamaldehyde compounds), acetylenic compounds (e.g., acetylenic alcohols), quaternary ammonium compounds, condensation reaction products (e.g., Mannich condensation products), iodides, solvents, surfactants, and any combination thereof. As used herein, "corrosion inhibitor" is a chemical compound or element that can decrease the corrosion rate of a material such as a metal or an alloy.

The term "cinnamaldehyde compound" as used herein refers to cinnamaldehyde and cinnamaldehyde derivatives. Cinnamaldehyde derivatives may include any compound that may act as a source of cinnamaldehyde in mixtures encountered during use of the corrosion inhibitors. Examples of cinnamaldehyde derivatives suitable for use in the present invention include, but are not limited to, dicinnamaldehyde, p-hydroxycinnamaldehyde, p-methylcinnamaldehyde, p-ethylcinnamaldehyde, p-methoxycinnamaldehyde, p-dimethylaminocinnamaldehyde, p-diethylaminocinnamaldehyde, p-nitrocinnamaldehyde, o-nitrocinnamaldehyde, o-allyloxycinnamaldehyde, 4-(3-propenal)cinnamaldehyde, p-sodium sulfocinnamaldehyde, p-trimethylammoniumcinnamaldehyde sulfate, p-trimethylammoniumcinnamaldehyde, o-methylsulfate, p-thiocyanocinnamaldehyde, p-(S-acetyl)thiocinnamaldehyde, p-(S—N,N-dimethylcarbamoylthio)cinnamaldehyde, p-chlorocinnamaldehyde, α-methylcinnamaldehyde, β-methylcinnamaldehyde, α-chlorocinnamaldehyde, α-bromocinnamaldehyde, α-butylcinnamaldehyde, α-amylcinnamaldehyde, α-hexylcinnamaldehyde, α-bromo-p-cyanocinnamaldehyde, α-ethyl-p-methylcinnamaldehyde, p-methyl-α-pentylcinnamaldehyde, cinnamaloxime, cinnamonitrile, 5-phenyl-2,4-pentadienal, 7-phenyl-2,4,6-heptatrienal, and mixtures thereof.

Acetylenic compounds suitable for use in the present invention may include acetylenic alcohols such as, for example, acetylenic compounds having the general formula: R7CCCR8R9OH wherein R7, R8, and R9 are individually selected from the group consisting of hydrogen, alkyl, phenyl, substituted phenyl hydroxy-alkyl radicals. In certain embodiments, R7 comprises hydrogen. In certain embodiments, R8 comprises hydrogen, methyl, ethyl, or propyl radicals. In certain embodiments, R9 comprises an alkyl radical having the general formula CnH2n, where n is an integer from 1 to 10. In certain embodiments, the acetylenic compound R7CCCR8R9OR10 may also be used where R10 is a hydroxy-alkyl radical. Examples of acetylenic alcohols suitable for use in the present invention include, but are not limited to, methyl butynol, methyl pentynol, hexynol, ethyl octynol, propargyl alcohol, benzylbutynol, ethynylcyclohexanol, ethoxy acetylenics, propoxy acetylenics, and mixtures thereof. Examples of suitable alcohols include, but are not limited to, hexynol, propargyl alcohol, methyl butynol, ethyl octynol, propargyl alcohol ethoxylate (e.g., GOLPANOL PME), propargyl alcohol propoxylate (e.g., GOLPANOL PAP), and mixtures thereof. When used, the acetylenic compound may be present in an amount of about 0.01% to about 10% by weight of the treatment fluid. In certain embodiments, the acetylenic compound may be present in an amount of about 0.1% to about 1.5% by weight of the treatment fluid.

Examples of quaternary ammonium compounds suitable for use in the present invention include, but are not limited to, N-alkyl, N-cycloalkyl and N-alkylarylpyridinium halides such as N-cyclohexylpyridinium bromide or chloride, N-alkyl, N-cycloalkyl and N-alkylarylquinolinium halides such as N-dodecylquinolinium bromide or chloride, the like and mixtures thereof.

As referred to herein, the condensation reaction product in this blend is hereby defined to include the reaction product of effective amounts of one or more active hydrogen-containing compounds with one or more organic carbonyl compound having at least one hydrogen atom on the carbon atom alpha to the carbonyl group and a fatty acid or other fatty compound or alkyl nitrogen heterocycles and preferably 2 or 4 alkyl substituted and an aldehyde, and, in certain embodiments, those aldehydes that may comprise aliphatic aldehydes containing from 1 to 16 carbons and aromatic aldehydes having no functional groups that are reactive under the reaction conditions other than aldehydes. The above ingredients may be reacted in the presence of an acid catalyst of sufficient strength to thereby form the reaction product. These condensation reaction products are described in more detail in U.S. Pat. No. 5,366,643, the entire disclosure of which is hereby incorporated by reference.

It is generally advantageous to be able to predict when a material may mechanically fail. However, in many real world applications, stresses will not be constant in magnitude but vary over a wide range. As a result of these variations in stress magnitudes, Miner's rule is often used to provide a cumulative damage model in predicting the failure of a material:

$$\sum_{i=1}^{k} n_i / N_i = C$$

where k is the number of different stress levels, $n_i$ is the number of applied load cycles at constant stress $S_i$, $N_i$ is the fatigue life at constant stress level $S_i$ (typically obtained from an S-N curve) and C is damage or the fraction of life consumed by exposure to the cycles. A material is predicted to fail when C is 1.

If the tensile stress at maximum working pressure is lower than the fatigue limit, then Miner's rule does not apply as the alloy should have a near infinite fatigue life. However, if the tensile stress at maximum working pressure is above the fatigue limit, then Miner's rule would apply as shown below.

Under ideal conditions (e.g., see FIG. 1), the maximum fatigue life at a maximum tensile stress of 74 ksi due to maximum working pressure of 20,000 psi in a particular fluid end is approximately 400,000 cycles. If all cycles were to occur at this maximum working pressure, then both $n_i$ and $N_i$ would be 400,000 giving a life of 1. At each other cyclic pressure condition, the cycles to failure at that pressure would be approximately:

$$\text{Actual cycles}=\text{cycles at max stress}*(\text{max stress/actual stress})^y$$

The exponent y will vary based on the material and may be experimentally determined. The value for y typically ranges from about 1.5 to about 8 depending on the material. The percentage of life used up for all pressure conditions would be:

$$\text{Life percentage}=n_1/N_1+n_2/N_2+n_3/N_3+ - - - +n_k/N_k$$

where each $n_i$ is the actual cycles at pressure i, and $N_i$ is the number of cycles at pressure i that would cause a fatigue failure.

Alternatively, Miner's rule can be applied such that fatigue cycles at each pressure are first adjusted to an equivalent number of cycles at another pressure. Often the equivalent condition chosen is the maximum working pressure. The following equation would allow the adjustment of pressure cycles at one pressure to an equivalent number of pressure cycles at maximum working pressure:

$$\text{Equiv cycles}=\text{cycles at actual pressure}*(\text{actual pressure/max pressure})^3$$

For this approach, the life percentage would be $$\text{Life percentage}=(n_1+n_2+n_3+ - - - +n_k)/N_k$$

where each $n_i$ is the equivalent cycle at maximum pressure that would equal the actual cycle at the pressure i and $N_K$ is the number of cycles to failure at the maximum working pressure.

In some embodiments, the fatigue limit of the corrosion resistant alloy of a fluid end is greater than or equal to the tensile stress on the fluid end at maximum working pressure. In some embodiments, the fatigue limit of the corrosion resistant alloy of a fluid end is greater than or equal to the tensile stress on the fluid end at maximum working pressure exposed to a corrosive well treating fluid. Corrosive well treating fluids may typically have components such as, but not limited to, guar gum, xanthan gum, hydroxyl-propyl-guar, hydroxyl-methyl-cellulose, salt (e.g., KCl), water, diesel, liquid carbon dioxide, polyacrylamide, and acid (e.g., sulfuric acid, hydrochloric acid, etc.). Without being limited by theory, it is believed that the maximum tensile stress on a body can be lowered through autofrettage. In some embodiments, the corrosion resistant alloy of a fluid end may be treated by autofrettage to lower a maximum tensile stress on the fluid end. As used herein, "autofrettage" refers to a metal fabrication technique in which a pressure vessel is subjected to enormous pressure, causing internal portions to yield, resulting in internal compressive residual stresses. Autofrettage is typically used to increase the fatigue life of a product.

In some embodiments, the present invention provides methods generally comprising: providing a well service pump that comprises a fluid end made from a corrosion resistant alloy comprising: iron; chromium; and an alloying element selected from the group consisting of: nickel, molybdenum, titanium, aluminum, copper, niobium, carbon, silicon, manganese, and any combination of these; and performing a fracturing treatment using the well service pump.

In some embodiments, the fracturing treatment comprises: providing a fracturing fluid comprising: a corrosion inhibitor.

To facilitate a better understanding of the present invention, the following examples of preferred embodiments are given. In no way should the following examples be read to limit, or to define, the scope of the invention.

EXAMPLE 1

Two steel alloys were tested for their resistance effects against corrosion and wear. The test involved several experiments including laboratory fatigue testing in air and water, including salt water environments simulating frac fluids which frequently come into contact with fluid ends used on well service pumps. Fluid ends often fail from cracks initiated at wetted surfaces via corrosion fatigue.

The two steel alloys tested were a martensitic age-hardenable stainless steel, commercially-available as "CUSTOM 450®" from Carpenter Technology Corporation, Wyomissing, Pa. and a NiCrMoV hardened and tempered high strength alloy steel, commercially available as "4330V" from Sunbelt Steel, Houston, Tex. The lines in FIG. 1 represent fatigue data on axial tensile test coupons tested at a stress ratio of 0.1 with both of the steel alloys heat treated to 135 ksi yield strength. The 4330V steel coupon was first tested in air and displayed a fatigue limit around 100 ksi. The fatigue limit may be illustrated by the horizontal stress line, below which the material has an infinite fatigue life. The 4330V was also tested in potable water (i.e., tap water) and salt water. In the ranges tested, 4330V does not have a fatigue limit in tap and salt water (see sloped lines in FIG. 1). In other words, there is no stress level below which there is infinite fatigue life.

The tests also indicated that the 4330V fluid ends would fail if they were operating in the Haynesville formation located in East Texas and Western Louisiana regions (at 74 ksi). The 74 ksi is the maximum stress in the fluid end when the service well pump is operating at 20,000 psi pressure. Each of the failures were first adjusted to equivalent full load cycles to determine the equivalent cycles at 20,000 psi to failure. Unless a material with a fatigue limit above 74 ksi stress is used, the maximum expected life under ideal conditions is approximately 400,000 cycles. This is shown in FIG. 1 where a horizontal line is drawn at 74 ksi and the point where this horizontal line intersects the 4330V lines. A vertical line drawn from this intersection points to the x-axis crossing this axis at approximately 400,000 cycles. This has also been confirmed on pumps in actual operation.

Finally, FIG. 1 also shows the CUSTOM 450® testing results. The CUSTOM 450® was tested similarly to the 4330V in salt water. Testing at 70 ksi and 100 ksi in salt water, CUSTOM 450® showed no failures after 10,000,000 cycles. This indicates that the fatigue limit of CUSTOM 450® is somewhere above 100 ksi. At 110 and 120 ksi, the fatigue life was 507,000 and 186,000 cycles respectively. This indicates that CUSTOM 450® has a fatigue limit in salt water somewhere between 100 ksi and 120 ksi.

The above example demonstrates, among other things, the effectiveness of corrosion resistant alloy as a material which can be used in fluid ends of water service pumps.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

providing a well service pump;

providing a fluid end body that comprises a corrosion resistant alloy (a) having a fatigue limit of at least 75 ksi and (b) comprising chromium as an alloying element at 5% or greater by weight of the corrosion resistant alloy;

installing the fluid end body in the well service pump; and pumping an aqueous-based fluid through the fluid end body, wherein the fatigue limit is greater than or equal to a tensile stress assumed by the fluid end body when the well service pump operates at maximum working pressure while pumping the aqueous-based fluid, wherein the aqueous-based fluid has a salt concentration of about 4% by weight or greater.

2. The method of claim 1, further comprising treating the fluid end body by autofrettage and thereby increasing the fatigue limit.

3. The method of claim 1 wherein the aqueous-based fluid further comprises a corrosion inhibitor.

4. The method of claim 3 wherein the corrosion inhibitor is selected from the group consisting of: an iodide, a surfactant, a hexamine, a benzotriazole, a phenylenediamine, a dimethylethanolamine, a polyaniline, a nitrite, a nitrate, a cinnamaldehyde compound, an acetylenic compound, a quaternary ammonium compound, a condensation reaction product, and any combination thereof.

5. A method comprising:

providing a well service pump;

providing a fluid end body comprising a corrosion resistant alloy (a) having a fatigue limit of at least 75 ksi and (b) comprising chromium at 5% or greater by weight of the corrosion resistant alloy coupling the fluid end body to the well service pump; and pumping an aqueous-based fluid through the fluid end body, wherein the aqueous-based fluid includes a corrosion inhibitor and the fatigue limit is greater than or equal to a tensile stress assumed by the fluid end body when the well service pump operates at maximum working pressure while pumping the aqueous-based fluid with corrosion inhibitor, wherein the aqueous-based fluid has a salt concentration of about 4% by weight or greater.

6. The method of claim 5 wherein the corrosion inhibitor comprises one inhibitor selected from the group consisting of: an iodide, a surfactant, a hexamine, a benzotriazole, a phenylenediamine, a dimethylethanolamine, a polyaniline, a nitrite, a nitrate, a cinnamaldehyde compound, an acetylenic compound, a quaternary ammonium compound, a condensation reaction production, and any combination thereof.

7. The method of claim 5 wherein the corrosion resistant alloy further comprises a second alloying element selected from the group consisting of iron and nickel.

8. The method of claim 5, further comprising treating the fluid end body by autofrettage and thereby increasing the fatigue limit.

9. A method comprising:

providing a well service pump that comprises a fluid end body made from a corrosion resistant alloy having a fatigue limit of at least 75 ksi, the corrosion resistant alloy comprising:

iron;

chromium in an amount of from about 5% to about 20%; and an alloying element selected from the group consisting of:

molybdenum, copper, niobium, and any combination of these;

pumping a fracturing fluid through the fluid end body, wherein the fatigue limit is greater than or equal to a tensile stress assumed by the fluid end body when the well service pump operates at maximum working pressure while pumping the fracturing fluid; and performing a fracturing treatment using the well service pump wherein the fracturing fluid has a salt concentration of about 4% by weight or greater.

10. The method of claim 9, further comprising treating the fluid end body by autofrettage and thereby increasing the fatigue limit.

11. The method of claim 9 wherein the fracturing fluid comprises a corrosion inhibitor.

12. The method of claim 11 wherein the corrosion inhibitor comprises one inhibitor selected from the group consisting of: an iodide, a surfactant, a hexamine, a benzotriazole, a phenylenediamine, a dimethylethanolamine, a polyaniline, a nitrite, a nitrate, a cinnamaldehyde compound, an acetylenic compound, a quaternary ammonium compound, a condensation reaction production, and any combination thereof.

* * * * *